United States Patent [19]

Clements et al.

[11] Patent Number: 4,557,477

[45] Date of Patent: Dec. 10, 1985

[54] STRIKING DEVICE

[76] Inventors: Ivan C. Clements, c/o George Spector, 3615 Woolworth Bldg., 233 Broadway; George Spector, 3615 Woolworth Bldg.,233 Broadway, both of New York, N.Y. 10007

[21] Appl. No.: 551,602

[22] Filed: Nov. 14, 1983

[51] Int. Cl.[4] ..... A63B 69/00

[52] U.S. Cl. ..... 272/76

[58] Field of Search ..... 272/76, 77, 78, 126; 273/55 R, 55 A, 354, 127 D, 343, 407

[56] References Cited

U.S. PATENT DOCUMENTS

| | | | |
|---|---|---|---|
| D. 169,243 | 4/1953 | Doherty | 272/76 |
| 2,156,831 | 5/1939 | Andre | 272/77 |
| 2,620,188 | 12/1952 | Malagio | 273/55 A |
| 3,250,533 | 5/1966 | Nicholson | 272/76 |
| 3,399,891 | 9/1968 | McCormick et al. | 272/78 |
| 3,421,759 | 1/1969 | Chambers | 272/76 |
| 3,984,101 | 10/1976 | Garza | 272/126 |
| 4,121,822 | 10/1978 | Di Sabatino et al. | 272/78 |
| 4,345,755 | 8/1982 | Eidson | 272/78 |

*Primary Examiner*—Richard J. Apley
*Assistant Examiner*—S. R. Crow

[57] ABSTRACT

A striking bag and support frame is provided and consists of a main bag having three heads at the top and a counter balance at the bottom with adjustable straps and chains supported within a frame assembly that can fit into a corner of a room.

3 Claims, 11 Drawing Figures

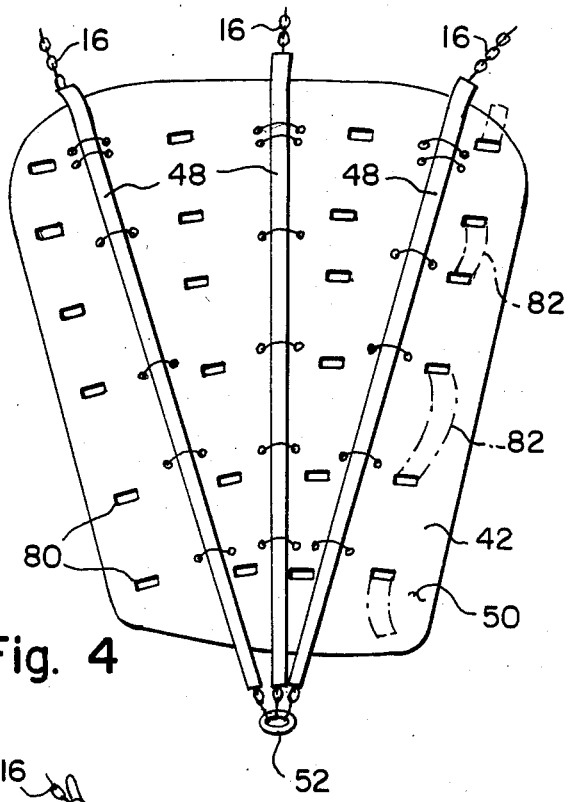
Fig. 4
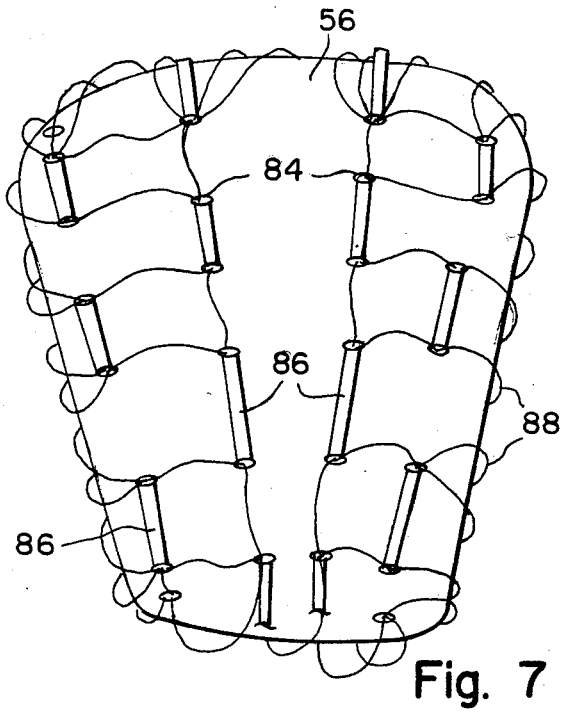
Fig. 7
Fig. 6
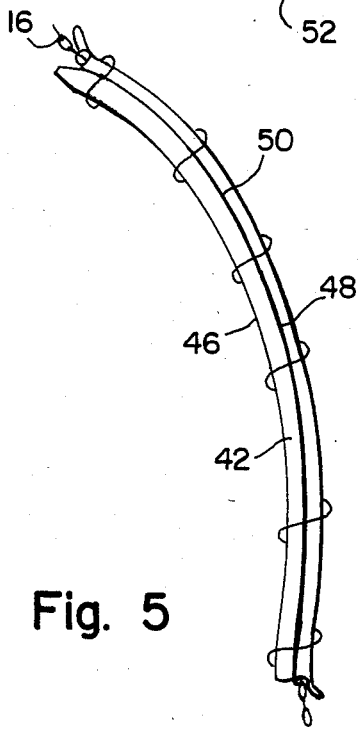
Fig. 5
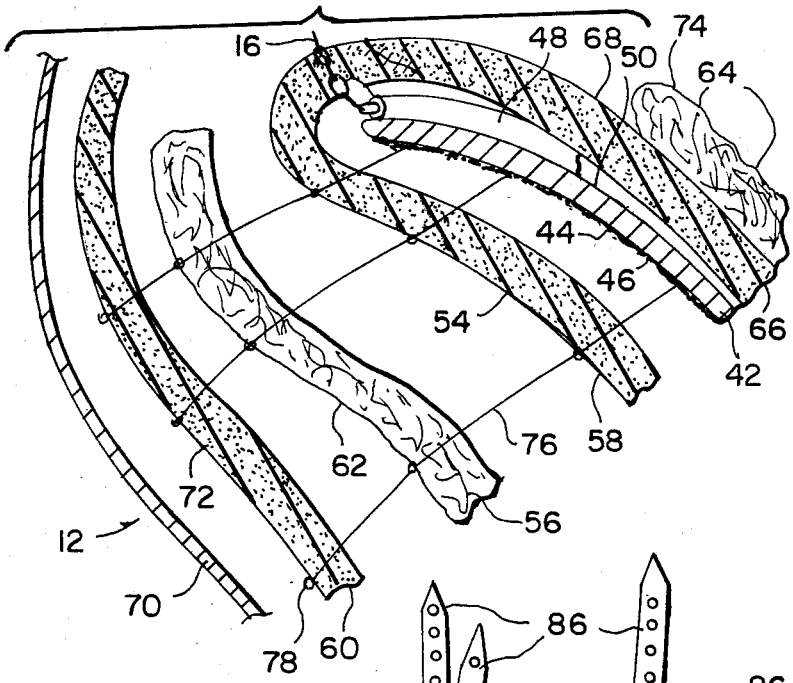
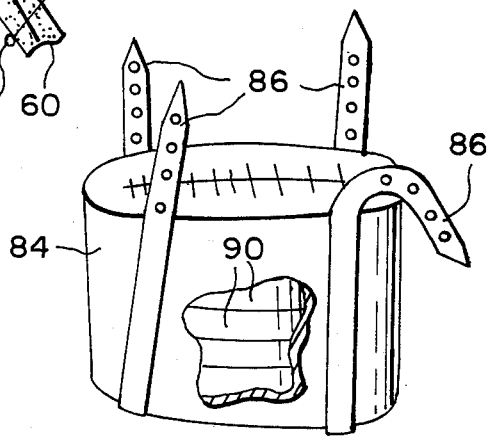
Fig. 8

STRIKING DEVICE

BACKGROUND OF THE INVENTION

The instant invention relates generally to punching bags and more specifically it relates to a striking bag and support frame.

All boxing gymnasiums have a trainer and or a coach to teach young boxers and fighters the correct way to punch so as so win fights as quickly as they can. Each trainer/coach has to enter the ring with punching pads taking all the blows whereby these blows take their toll. This situation is not desirable so accordingly it is in need of an improvement.

SUMMARY OF THE INVENTION

A principle object of the present invention is to provide a striking bag and support frame that can be raised, lowered and angled at different degrees to teach a boxer the style of the other boxer.

Another object is to provide a striking bag and support frame that teaches a boxer how to stand and trade punches with power.

An additional object is to provide a striking bag and support frame that teaches a boxer the right way in placing the feet for better leverage and the right angle of the delivery of the blow.

A further object is to provide a striking bag and support frame that teaches a boxer the lateral movement of the body as required and the right use of the legs to attain more pressure in improving power punching.

A still further object is to provide a striking bag and support frame that is designed to fit into a corner of the gymnasium, thus use the most wasted space.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 4 is a rear view of the baseboard within the striking bag.

FIG. 5 is a side view of the baseboard.

FIG. 6 is an exploded partial side cross sectional view of the striking bag.

FIG. 7 is a rear view of packing within the striking bag.

FIG. 8 is a perspective view of a modified counter balance bag.

DETAILED DESCRIPTION OF THE PREFERRED EMBODIMENTS

Figure 1:
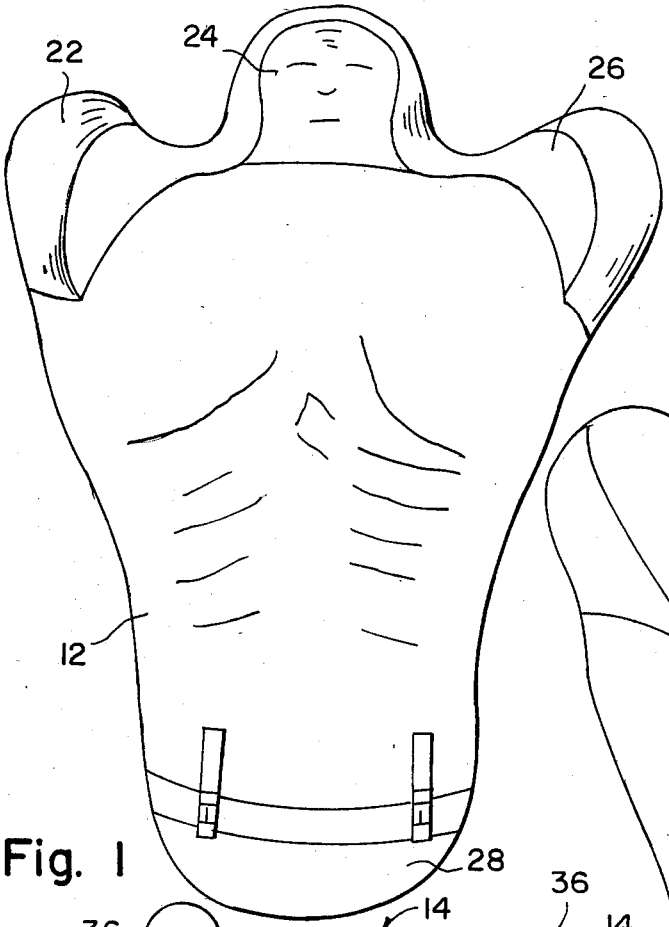
FIG. 1 is a front view of the striking bag.
Figure 10:
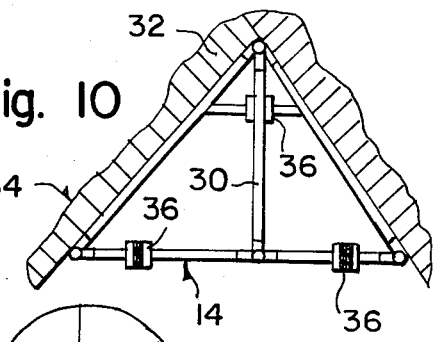
FIG. 10 is a top view of the frame assembly in a corner of a room.
Figure 2:
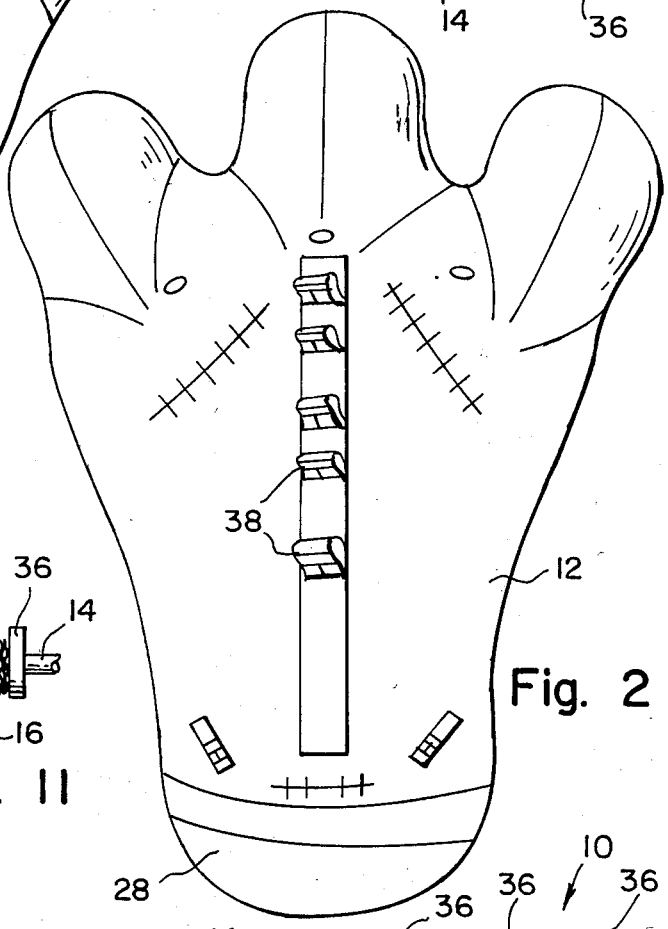
FIG. 2 is a rear view of the striking bag.
Figure 11:
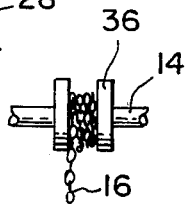
FIG. 11 is a front view of one of three automatic winding devices on the frame assembly.
Figure 3:
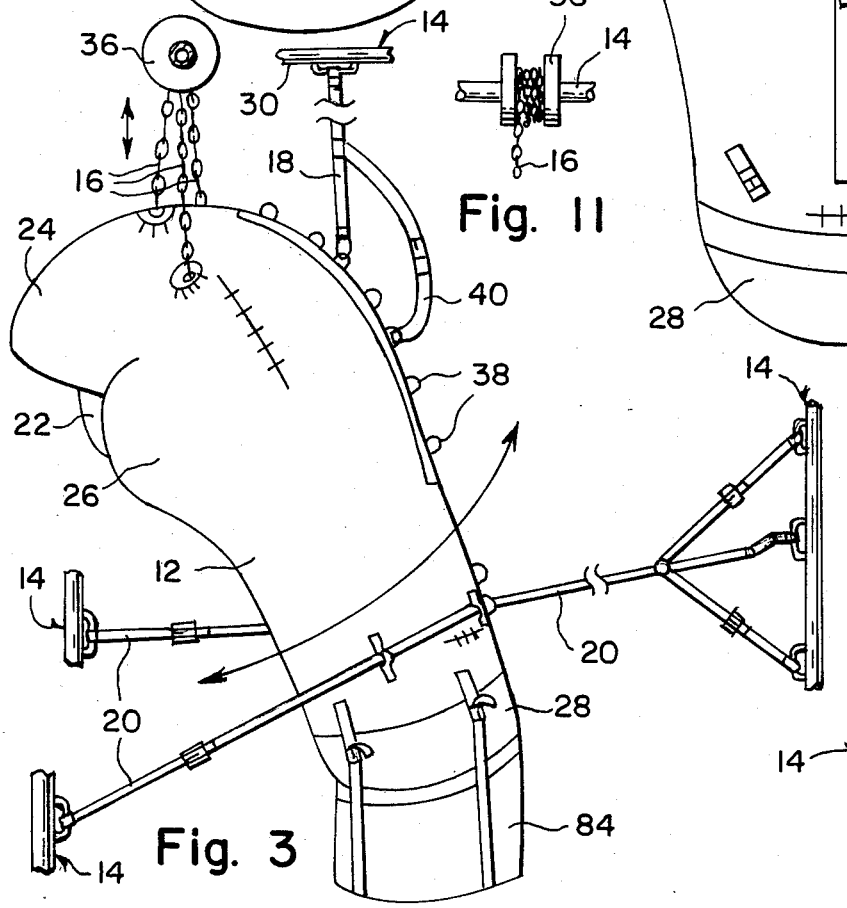
FIG. 3 is a side view of the striking bag showing adjustable straps and chains.
Figure 9:
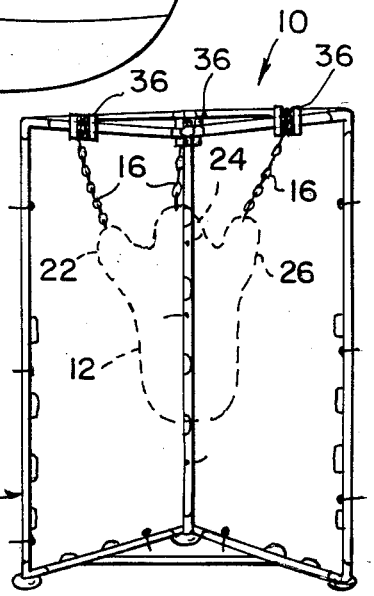
FIG. 9 is a front perspective view of the frame assembly.

Turning now descriptively to the drawings, in which similar reference characters denote similar elements throughout the several views, FIGS. 1 through 11 illustrates a striking bag and support frame 10 which consists of a main bag 12, a frame assembly 14, three chains 16 for supporting the main bag 12 within the frame assembly 14, an adjustment strap 18 for tilting the main bag 12 formed and rearward within the frame assembly 14 and straps 20 for stabilizing the main bag 12 within the frame assembly 14.

The main bag 12 has three heads 22, 24 and 26 at the top and a counter balance 28 that can be removable at the bottom. The frame assembly 14 is triangular in shape and has a top cross bar 30. The frame assembly 14 can fit into a corner 32 of a room 34 (see FIG. 10). The three chains 16 are each affixed between the top of the frame 14 and into the back of the main bag behind each of the heads 22, 24 and 26 (see FIG. 3). Each of the chains is rotatably mounted to an automatic winding device 36 on the top of the frame assembly 14 so that the main bag 12 can be raised, lowered and tilted to the left side and right side when needed by operating the devices 36 in different combinations (not shown).

The adjustment strap 18 is connected between the top cross bar 30 of the frame assembly 14 and one of a plurality of loops 38 mounted in a vertical line on back surface of the main bag 12. An auxiliary adjustment strap 40 can be connected between the middle of the adjustment strap 18 and another one of the loops 38, when the adjustment strap 18 is removed from the loop 38 the main bag 12 will drop until the slack is taken up by the auxiliary adjustment strap 40 placing the main bag 12 is a different tilting position.

The straps 20 are connected between the bottom of the main bag 12 near the counter balance 28 and the side of the frame assembly 14 to hold and control the main bag 12 from moving about.

As shown in FIGS. 4, 5, 6 and 7 the main bag 12 further consists of a baseboard 42 having adhesive 44 on the front side 46. The baseboard 42 forms a stiff curved back for support. Three flexible hoses 48 are spaced apart and mounted to the rear side 50 of the baseboard 42, such as metal bolted straps or nylon rope, so that they taper to meet at the bottom. Each hose 48 allows each of the chains 16 to enter and be linked together at 52 at the bottom.

A first layer of sponge rubber 54 is wrapped around the front 46 and rear side 50 of the baseboard 42 and three flexible hoses 48 so that the baseboard 42 will adhere to the sponge rubber 54 and allow the three chains 16 to exit at top. A layer of padding 56 is placed against rear side 58 of the first layer of sponge rubber 54 to adsorb shock from blows to the main bag 12. A second layer of sponge rubber 60 is placed against rear side 62 of the layer of padding 56.

A plurality of plastic bags 64 containing cotton waste 66 is placed against front side 68 of the first layer of sponge rubber 54 for extra weight. An outer cover 70 is placed around rear side 72 of the second layer of sponge rubber 60 and front side 74 of the plurality of plastic bags 64 containing the cotton waste 66 whereby the first layer of sponge rubber 54, the layer of padding 56 and the second layer of sponge rubber 60 is secured to the baseboard 42 by waxed cord 76 and upholstery type buttons 78.

A plurality of slit holes 80 can be placed into the baseboard 42 so that canvas straps 82 can be laced therethrough and attached to the outer cover 70. This will prevent the baseboard 42 from slipping within. A plurality of slit holes 84 can be placed into the layer of padding 56 so that canvas straps 86 and nylon cord 88 can be placed therethrough. The straps 86 and nylon cord 88 hold the padding 56 in shape and secure the padding 56 inside the main bag 12.

FIG. 8 shows in greater detail another type of counter balance that is a bag 84 that can be secured to the main bag 12 with or without the counter balance 28. Four straps 86 are provided so that the bag 84 can be easily secured. Inside the bag 84 are a series of heavy plates 90 so that the weight of the bag 84 can be changed depending upon the size and shape of the main bag 12.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A striking bag and support frame which comprises:

(a) a main bag having three heads at the top and a counter balance at bottom;

(b) a frame assembly;

(c) means for supporting the main bag within the frame assembly;

(d) means for tilting the main bag forward and rearward within the frame assembly; and (e) means for stabilizing the main bag within the frame assembly, wherein said frame assembly is triangular in shape having a top cross bar so that the frame assembly can fit into a corner of a room, wherein said means for supporting said main bag within the frame assembly are three chains, each one affixed between the top of the frame assembly and into the back of the main bag behind each of said heads, wherein each of the chains is rotatably mounted to an automatic winding device on the top of said frame assembly so that said main bag can be raised, lowered and tilted to left side and right side when needed, wherein said means for tilting said main bag forward and rearward comprises:

(a) a plurality of loops mounted in a vertical line on a back surface of said maIn bag;

(b) an adjustment strap connected between one of said loops and said top cross bar of said frame assembly; and (c) an auxiliary adjustment strap connected between the middle of said adjustment strap and another one of said loops so that when said adjustment strap is removed from said loop said main bag will drop until the slack is taken up by said auxiliary adjustment strap placing said main bag in a different tilting position.

2. A striking bag and support frame as recited in claim 1, wherein said means for stabilizing said main bag within said frame assembly is at least one strap connected between the bottom of said main bag near said counter balance and the side of the frame assembly to hold and control said main bag from moving about.

3. A striking bag and support frame as in claims 1, wherein said main bag further comprises:

(a) a baseboard having adhesive on a front side; and said baseboard forms a stiff curved back for support;

(b) three flexible hoses spaced apart and mounted to a rear side of said baseboard so that they taper to meet at the bottom, each hose allowing each of the chains to enter and be linked together at the bottom;

(c) a first layer of sponge rubber wrapped around said front and rear sides of said baseboard and three flexible hoses so that said baseboard will adhere to the sponge rubber and allow the three chains to exit at top;

(d) a layer of padding placed against said rear side of said first layer of sponge rubber to absorb shock from blows to said main bag;

(e) a second layer of sponge rubber placed against said rear side of said layer of padding;

(f) a plurality of plastic bags containing cotton waste placed against said front side of said first layer of sponge rubber for extra weight; and (g) an outer cover placed around said rear side of said second layer of sponge rubber and said front side of said plurality of plastic bags containing cotton waste whereby said first layer of said sponge rubber, said layer of padding and said second layer of sponge rubber is secured to said baseboard.

* * * * *